US012760954B2

(12) United States Patent
Frost et al.

(10) Patent No.: US 12,760,954 B2
(45) Date of Patent: Oct. 13, 2026

(54) TRANSPORT PODS

(71) Applicant: HUBL LOGISTICS LTD, Bingham (GB)

(72) Inventors: Hugh Frost, Bingham (GB); Ronald Bickerton, Bingham (GB)

(73) Assignee: HUBL LOGISTICS LTD, Bingham (GB)

( * ) Notice: Subject to any disclaimer, the term of this patent is extended or adjusted under 35 U.S.C. 154(b) by 66 days.

(21) Appl. No.: 18/570,869

(22) PCT Filed: Jun. 17, 2022

(86) PCT No.: PCT/GB2022/051533
§ 371 (c)(1),
(2) Date: Dec. 15, 2023

(87) PCT Pub. No.: WO2022/263840
PCT Pub. Date: Dec. 22, 2022

(65) Prior Publication Data

US 2024/0318890 A1 Sep. 26, 2024

(30) Foreign Application Priority Data

| | | |
|---|---|---|
| Jun. 18, 2021 | (GB) | 2108787 |
| Jun. 18, 2021 | (GB) | 2108790 |
| Jun. 18, 2021 | (GB) | 2108792 |
| Jun. 18, 2021 | (GB) | 2108793 |
| Jun. 18, 2021 | (GB) | 2108795 |

(51) Int. Cl.
*F25D 3/06* (2006.01)
*F25D 17/04* (2006.01)
(Continued)

(52) U.S. Cl.
CPC ..... *F25D 3/06* (2013.01); *F25D 17/04* (2013.01); *F25D 25/005* (2013.01); *F25D 19/04* (2013.01); *F25D 2303/0844* (2013.01)

(58) Field of Classification Search
CPC ..... F25D 17/04; F25D 25/005; F25D 19/04; F25D 2303/0844; F25D 3/06; F25D 2323/00278; F25D 3/00; F25D 3/045
See application file for complete search history.

(56) References Cited

U.S. PATENT DOCUMENTS 4,468,932 A * 9/1984 Bullard ..... F25D 3/08 62/421
5,441,170 A 8/1995 Bane
(Continued)

FOREIGN PATENT DOCUMENTS

CN 1185573 A 6/1998
CN 205245666 U 5/2016
(Continued)

OTHER PUBLICATIONS

DE-102005029907-A1 Translation (Year: 2005).*
(Continued)

*Primary Examiner* — David J Teitelbaum
(74) *Attorney, Agent, or Firm* — BURR & FORMAN

(57) ABSTRACT

There is provided a thermally-insulated transport pod (100), transport locker pods (100), a locker system (200), a docking station (330), and a dockable pod system (200).

7 Claims, 7 Drawing Sheets

(51) Int. Cl.
*F25D 25/00* (2006.01)
*F25D 19/04* (2006.01)

(56) References Cited

U.S. PATENT DOCUMENTS

| | | | | |
|---|---|---|---|---|
| 5,809,798 | A | 9/1998 | Clarke et al. | |
| 6,131,404 | A | 10/2000 | Hase et al. | |
| 6,138,578 | A | 10/2000 | Cowan et al. | |
| 8,358,195 | B2 | 1/2013 | Giles | |
| 9,527,605 | B1 | 12/2016 | Gentry et al. | |
| 2002/0040564 | A1 | 4/2002 | Killingbeck et al. | |
| 2004/0020236 | A1 | 2/2004 | Vince, II et al. | |
| 2004/0163408 | A1* | 8/2004 | Kim | F25D 23/003 62/428 |
| 2007/0204645 | A1 | 9/2007 | Balva et al. | |
| 2010/0192617 | A1* | 8/2010 | Chae | F25D 17/08 62/449 |
| 2010/0242506 | A1* | 9/2010 | Daddis, Jr. | F25D 17/06 62/428 |
| 2013/0144428 | A1 | 6/2013 | Irwin et al. | |
| 2018/0252466 | A1* | 9/2018 | Baker | B01L 7/52 |
| 2019/0162460 | A1 | 5/2019 | Oh | |
| 2019/0313828 | A1 | 10/2019 | Schmider et al. | |

FOREIGN PATENT DOCUMENTS

| | | | | | |
|---|---|---|---|---|---|
| CN | 210166868 | U | | 3/2020 | |
| CN | 211903455 | U | | 11/2020 | |
| DE | 20114408 | U | | 1/2002 | |
| DE | 102005029907 | A1 | * | 1/2007 | F25D 11/006 |
| EP | 1709895 | A1 | | 10/2006 | |
| GB | 2486539 | | | 6/2012 | |
| GB | 2505748 | A | | 3/2014 | |
| GB | 2518995 | | | 4/2015 | |
| GB | 2586919 | A | | 3/2021 | |
| JP | H05215455 | A | | 8/1993 | |
| JP | H06331261 | A | | 11/1994 | |
| JP | H08210765 | A | | 8/1996 | |
| JP | H10103836 | A | | 4/1998 | |
| JP | 2000172929 | A | | 6/2000 | |
| JP | 2000241056 | A | | 9/2000 | |
| JP | 2006170572 | A | * | 6/2006 | F25D 25/022 |
| JP | 2014206289 | A | | 10/2014 | |
| JP | 2015219629 | A | | 12/2015 | |
| KR | 20110029983 | A | | 3/2011 | |
| KR | 20130011288 | A | | 1/2018 | |
| WO | 2015044668 | A1 | | 4/2015 | |
| WO | WO2015150753 | | | 10/2015 | |
| WO | 2017075269 | A2 | | 5/2017 | |
| WO | WO2018064030 | A1 | | 4/2018 | |

OTHER PUBLICATIONS

JP-2006170572-A Translation (Year: 2006).*

Examination Report from corresponding African Application No. AP/P/2024/015743, mailed Jul. 20, 2026, all pages cited in its entirety.

* cited by examiner

TRANSPORT PODS

FIELD OF THE INVENTION

Some embodiments of the present invention relate to temperature-controlled transport pods. Some embodiments of the present invention relate to a locker system, a docking station, and a transport locker pod. Some embodiments of the present invention relate to a dockable pod system, a docking station, and a temperature-controlled transport pod.

BACKGROUND TO THE INVENTION

A cold chain or hot chain is a temperature-controlled supply chain. An unbroken cold chain comprises refrigerated production, storage and distribution. Various standards mandate that products such as items or fluids are kept within particular temperature ranges and mandate time limits for how long products are allowed to be kept outside the required range.

The last leg of distribution, known as the 'last mile', is the least efficient stage of distribution. Cages or pallets of products are loaded into delivery vehicles having cooled or heated cargo spaces, and delivered to local private or commercial customers or to collection points. The cargo space is typically heated or cooled by an auxiliary diesel engine. Such systems can reliably maintain a setpoint temperature over a long duration, which provides the operator with flexibility for a financial cost. However, it is inefficient to cool or heat the whole cargo space, particularly using systems that are thermodynamically inefficient and that may emit local pollutants.

With the increasing prevalence of online trade and click and collect operations, the efficient delivery of products to consumers presents increasing difficulties. In a polyopolistic courier market, different courier agents working for different courier companies will deliver consignments to the same click and collect points (static locker banks) resulting in high mileage and difficulties for transporting temperature-controlled products. At the click and collect points, lockers will need to be manually loaded with consignments and re-locked, which is labour-intensive and can result in errors. Click and collect points/locker banks also require individual locks which can be controlled so that only the intended delivery recipient can access the locker only when it contains their consignment.

BRIEF DESCRIPTION OF VARIOUS EMBODIMENTS OF THE INVENTION

According to various, but not necessarily all, embodiments of the invention there is provided a thermally-insulated transport pod for storage and transport of temperature-sensitive products, the transport pod comprising:

- a product storage space configured to contain temperature-sensitive products;
- a thermal energy device space configured to hold at least one thermal energy storage device for absorbing or emitting thermal energy to control a temperature of the product storage space, wherein the thermal energy device space is fluidly coupled to the product storage space to enable a convective air flow between the thermal energy device space and the product storage space when in use; and
- a convection cell flow guide configured to direct the convective air flow to recirculate in a convection cell spanning between the thermal energy device space and the product storage space.

This provides the advantage of a low energy or passive temperature-controlled transport pod with minimal stratification of temperatures therein. This enables the vehicle cargo space to be at an ambient temperature.

In some, but not necessarily all examples, a throttle is further provided to create a jet that further disrupts stratification of temperatures.

In some, but not necessarily all examples, the transport pod is double-sided which can be for maintaining products at different controlled temperatures.

In some, but not necessarily all examples, the transport pod is dockable to a docking station. In some, but not necessarily all examples, the transport pod is dockable to a docking station for temperature recharge. The docking station may be configured as a click and collect point or as a merchandise display point or as a vending/refill station.

According to various, but not necessarily all, embodiments of the invention there is provided a thermally-insulated transport pod for storage and transport of temperature-sensitive products, the transport pod comprising:

- a product storage space configured to contain temperature-sensitive products;
- a thermal energy device space configured to hold at least one thermal energy storage device for absorbing or emitting thermal energy to control a temperature of the product storage space, wherein the thermal energy device space is fluidly coupled to the product storage space to enable a convective air flow between the thermal energy device space and the product storage space when in use; and
- a variable throttle configured to control a flow rate of the convective air flow entering or leaving the product storage space.

This provides the advantage of a low energy or passive temperature-controlled transport pod with minimal stratification of temperatures therein. This enables the vehicle cargo space to be at an ambient temperature.

According to various, but not necessarily all, embodiments of the invention there is provided a thermally-insulated transport pod for storage and transport of temperature-sensitive products, the transport pod comprising:

- a product storage space configured to contain temperature-sensitive products;
- a thermal energy device space configured to hold at least one thermal energy storage device for absorbing or emitting thermal energy to control a temperature of the product storage space, wherein the thermal energy device space is fluidly coupled to the product storage space to enable a convective air flow between the thermal energy device space and the product storage space when in use; and
- a variable throttle configured to control a flow rate of the convective air flow entering or leaving the product storage space, wherein the variable throttle has a variable opening size.

In some, but not necessarily all examples, a convection cell flow guide is further provided to cause the convective air flow to recirculate in a convection cell spanning between the thermal energy device space and the product storage space. This provides the advantage of further minimising stratification of temperatures.

In some, but not necessarily all examples, the transport pod is double-sided which can be for maintaining products at different controlled temperatures.

In some, but not necessarily all examples, the transport pod is dockable to a docking station. In some, but not necessarily all examples, the transport pod is dockable to a docking station for temperature recharge. The docking station may be configured as a click and collect point or as a merchandise display point or as a vending/refill station.

According to various, but not necessarily all, embodiments of the invention there is provided a thermally-insulated transport pod for storage and transport of temperature-sensitive products, the transport pod comprising:

- a first product storage space configured to contain temperature-sensitive products;
- a first thermal energy device space configured to hold at least one first thermal energy storage device for absorbing or emitting thermal energy to control a temperature of the first product storage space;
- a first closure at a first side of the transport pod, configured to enable user access to the first product storage space; and
- a second closure at a second side of the transport pod, configured to enable user access to a second product storage space or the first product storage space.

This double-sided transport pod provides the advantage of ease of access for operatives or end users.

In some, but not necessarily all examples, the transport pod is configured to thermally insulate the second product storage space and the first product storage space from each other, enabling products to be maintained at different controlled temperatures.

In some, but not necessarily all examples, a convection cell flow guide is further provided to cause convective air flow to recirculate in a convection cell spanning between the first thermal energy device space and the first product storage space. This provides the advantage of a low energy or passive temperature-controlled transport pod with minimal stratification of temperatures therein. This enables the vehicle cargo space to be at an ambient temperature.

In some, but not necessarily all examples, a throttle is further provided to create a jet that further disrupts stratification of temperatures.

In some, but not necessarily all examples, the transport pod is dockable to a docking station. The docking station may be configured as a double-sided click and collect point or as a double-sided merchandise display point or as a double-sided vending/refill station. In some, but not necessarily all examples, the transport pod is dockable to a docking station for temperature recharge.

According to various, but not necessarily all, embodiments of the invention there is provided a locker system comprising:

- a plurality of transport locker pods each comprising a plurality of lockers; and
- a docking station comprising:
  - a plurality of docks each configured to receive one of the transport locker pods;
  - a controller configured to obtain an identification of a locker to be unlocked of a docked one or more of the transport locker pods in dependence on an access control operation; and
  - means for controlling access to the lockers including the identified locker.

This provides the advantage of a more efficient last mile delivery system. The transport locker pods can be packed at a central hub, such as a warehouse, and then transported to the docking station. The central hub may deliver transport locker pods to a plurality of docking stations at different locations. This efficiently prevents duplication of drop-off points for different couriers, reducing overall mileage and emissions. This also reduces labor requirements and increases security, temperature integrity and food hygiene for temperature-controlled implementations.

According to various, but not necessarily all, embodiments of the invention there is provided a locker system comprising:

- a plurality of transport locker pods each comprising a plurality of lockers; and
- a docking station comprising:
  - a plurality of docks each configured to receive one of the transport locker pods;
  - a controller configured to obtain an identification of a locker to be unlocked of a docked one or more of the transport locker pods in dependence on an access control operation; and
  - means for controlling access to the lockers including the identified locker, comprising a plurality of individually actuatable interference portions for each dock, different ones of the interference portions being configured to lock or unlock different lockers.

In some, but not necessarily all examples, each transport locker pod is temperature controlled. In some, but not necessarily all examples, each transport locker pod comprises a thermal energy storage device. In some, but not necessarily all examples, each transport locker pod comprises a convection cell flow guide to cause convective air flow to recirculate in a convection cell. This provides the advantage of a low energy or passive temperature-controlled transport locker pod with minimal stratification of temperatures therein. This enables the vehicle cargo space to be at an ambient temperature.

In some, but not necessarily all examples, each transport locker pod further comprises a throttle to create a jet that further disrupts stratification of temperatures.

In some, but not necessarily all examples, the docking station may be configured as a click and collect point or as a merchandise display point or as a vending/refill station. In some, but not necessarily all examples, the transport pod is dockable to a docking station for temperature recharge. In some, but not necessarily all examples, the transport pod is double-sided.

According to various, but not necessarily all, embodiments of the invention there is provided a docking station for receiving a plurality of transport locker pods each comprising a plurality of lockers, the docking station comprising:

- a plurality of docks each configured to receive one of the transport locker pods;
- a controller configured to obtain an identification of a locker to be unlocked of a docked one or more of the transport locker pods in dependence on an access control operation; and
- means for controlling access to the lockers including the identified locker.

According to various, but not necessarily all, embodiments of the invention there is provided a transport locker pod configured to dock to any one of a plurality of docks of a docking station, the transport locker pod comprising a plurality of lockers, wherein the lockers are:

- in a docked condition, lockable and/or unlockable individually via a lock actuator system of the docking station; and
- in an undocked condition, lockable collectively and/or unlockable collectively, or latchable and/or unlatchable, but not lockable individually and/or not unlockable individually.

According to various, but not necessarily all, embodiments of the invention there is provided a dockable pod system comprising:

a thermally-insulated transport pod for storage and transport of temperature-sensitive products, the transport pod comprising:

a product storage space; and a thermal energy device space configured to hold at least one thermal energy storage device for absorbing or emitting thermal energy at least while the transport pod is undocked, to control a temperature of the product storage space;

the dockable pod system further comprising a docking station comprising:

a dock configured to receive the transport pod; and a temperature control system configured to control the temperature of the product storage space while the transport pod is received in the dock.

This provides the advantage of an improved means of controlling temperature of delivery products. The low energy or passive temperature-controlled transport pod can be maintained at a required temperature when docked and can remain within a required temperature range for many hours before docking or after undocking. This enables the vehicle cargo space to be at an ambient temperature.

In some, but not necessarily all examples, the transport pod comprises a convection cell flow guide to cause convective air flow to recirculate in a convection cell spanning between the thermal energy device space and the product storage space. This provides the advantage of a low energy or passive temperature-controlled transport pod with minimal stratification of temperatures therein.

In some, but not necessarily all examples, a throttle is further provided to create a jet that further disrupts stratification of temperatures.

In some, but not necessarily all examples, the transport pod is double-sided which can be for maintaining products at different controlled temperatures.

In some, but not necessarily all examples, the docking station may be configured as a double-sided click and collect point or as a merchandise display point or as a vending/refill station.

According to various, but not necessarily all, embodiments of the invention there is provided a thermally-insulated transport pod for storage and transport of temperature-sensitive products, the transport pod configured to dock to a docking station, the transport pod comprising:

a product storage space;

a thermal energy device space configured to hold at least one thermal energy storage device for absorbing or emitting thermal energy while the transport pod is undocked, to control a temperature of the product storage space; and a fluid interface configured to enable thermal energy transfer via two-way exchange of fluid between the thermal energy device space of the transport pod and a temperature control system of the docking station to enable the temperature control system of the docking station to control the temperature of the product storage space while the transport pod is received in the dock.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 1A:
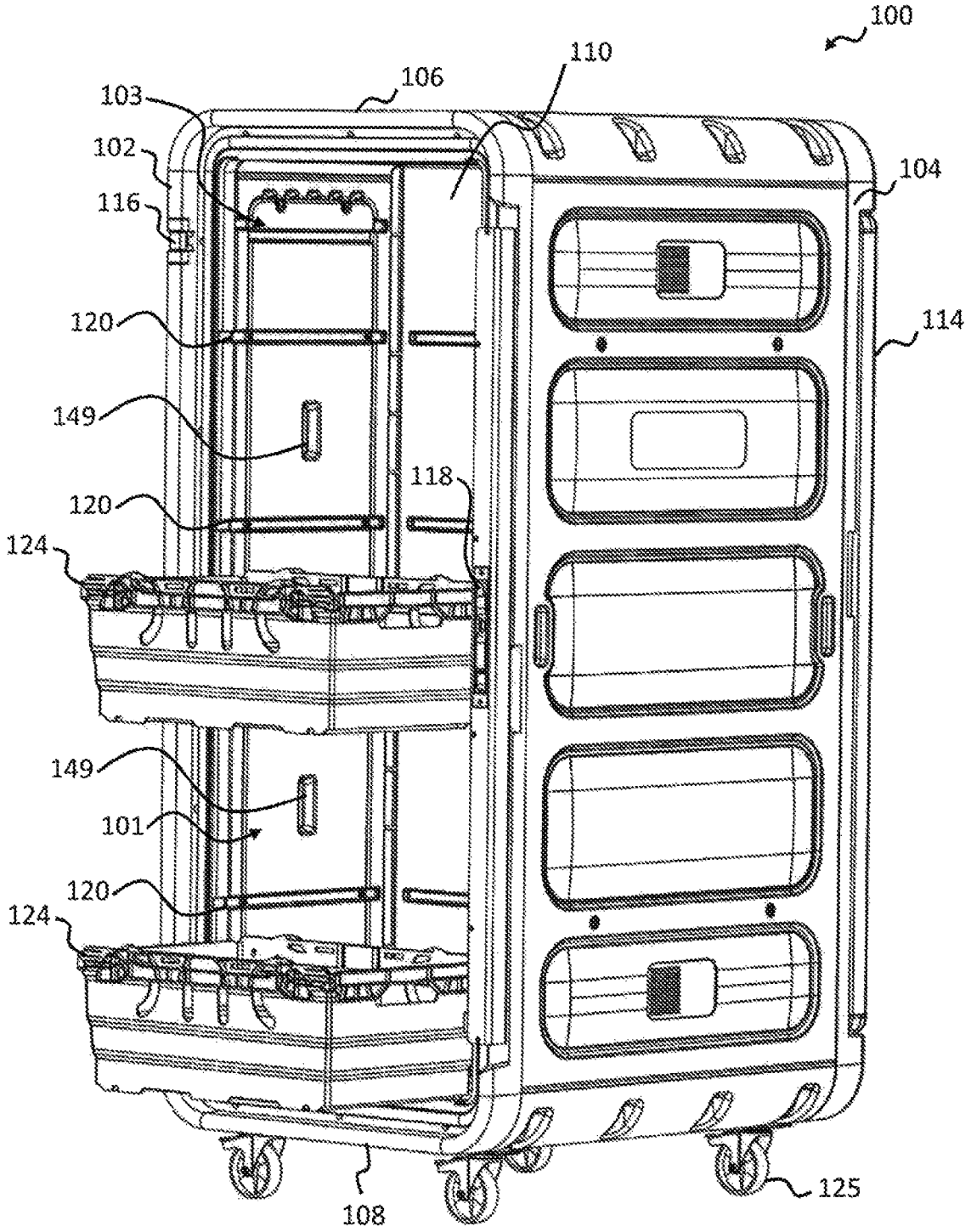
FIG. 1A illustrates an example of a transport pod.

FIG. 1A illustrates an example of a transport pod 100. The transport pod 100 is a container for loading into and unloading from delivery vehicle cargo spaces, configured for storage and transport of products.

The transport pod 100 can be sealable and can comprise temperature-controlled variants and non-temperature-controlled variants. The Figures illustrate temperature-controlled variants, comprising a low energy or passive temperature control system (see FIG. 3) configured to keep temperature-controlled products within a required temperature range for longer than 6 hours or longer than 10 hours. The transport pod 100 is therefore ideal for short-to-medium distance journeys.

In at least some examples, the internal volume of the transport pod 100 is greater than 0.1 metres cubed. In an implementation, the internal volume is greater than 0.5 metres cubed, enabling the transport pod 100 to contain medium-to-large cargos. The volume is still far smaller than the volume of the vehicle cargo space, such as less than two metres cubed, enabling use of a small, lightweight and low-energy temperature control system. In other examples, the transport pod is larger but the internal volume is still smaller than 4 metres cubed.

In at least some examples, the transport pod 100 is sized for multiple transport pods 100 to fit alongside each other in a standard transport vehicle cargo hold. For example, the longest external dimension of the transport pod 100, such as its height, can be less than two metres but more than one metre. In some examples, the shortest external dimension of the transport pod 100, such as its width, can be less than one metre but more than 40 centimetres.

In some examples, the transport pod 100 comprises wheels 125 such as casters, to enable the transport pod 100 to be moved as a roll cage. Additionally, or alternatively, the transport pod 100 can be moved by material handling equipment such as forklift or tug equipment. For example, the transport pod 100 can comprise a flat base, clam locks, or tug attachments.

Figure 6:
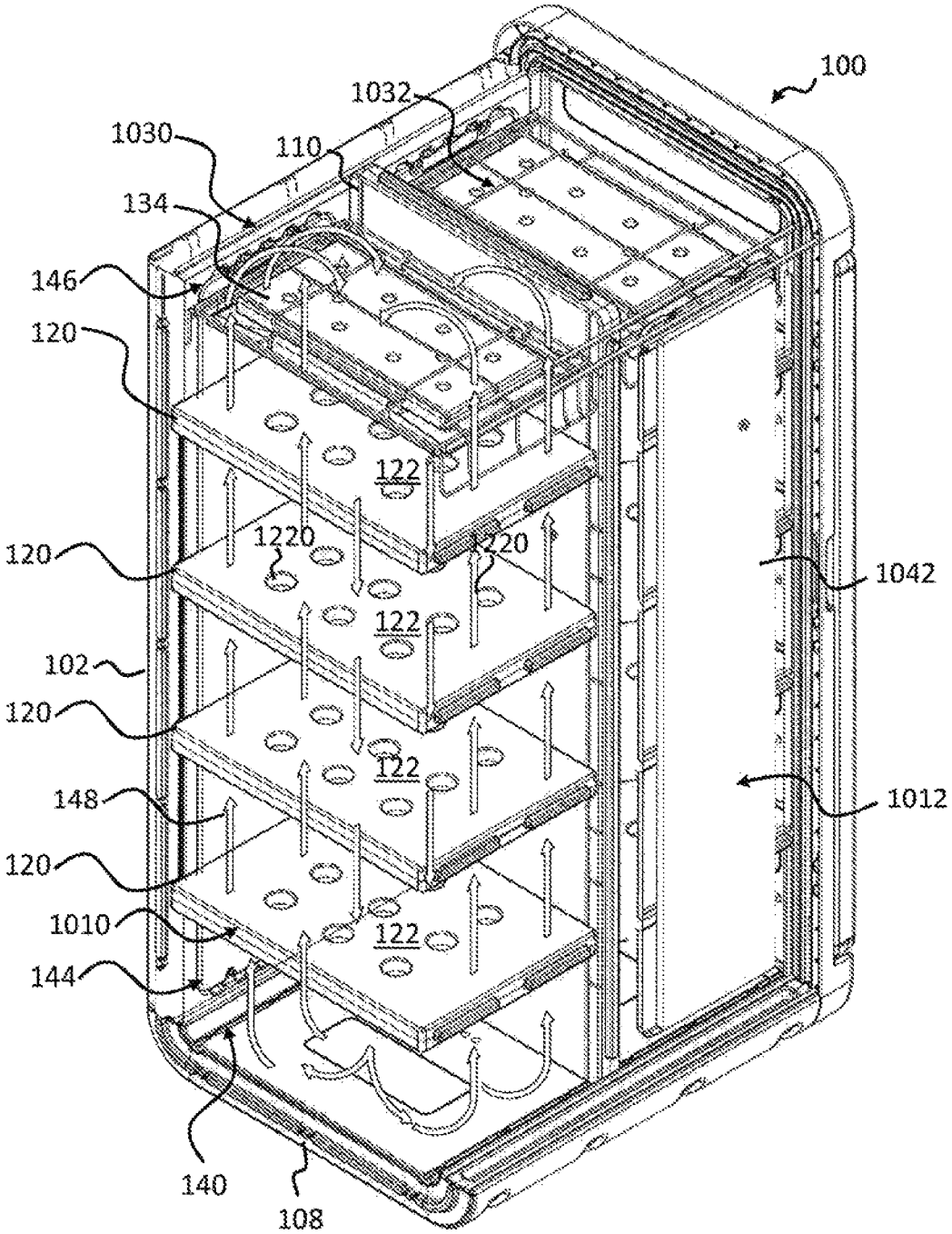
FIG. 6 illustrates an example of a transport pod comprising a convection cell flow guide.

The transport pod 100 of FIG. 1A comprises exterior panels. The exterior panels can comprise or support thermally-insulated panels. In some implementations, the thermally-insulated panels comprise vacuum insulated panels (VIPs). As shown in FIG. 6, an exterior panel may comprise a frame supporting a VIP 1042. Alternatively, the whole exterior panel can be a VIP.

Figure 2:
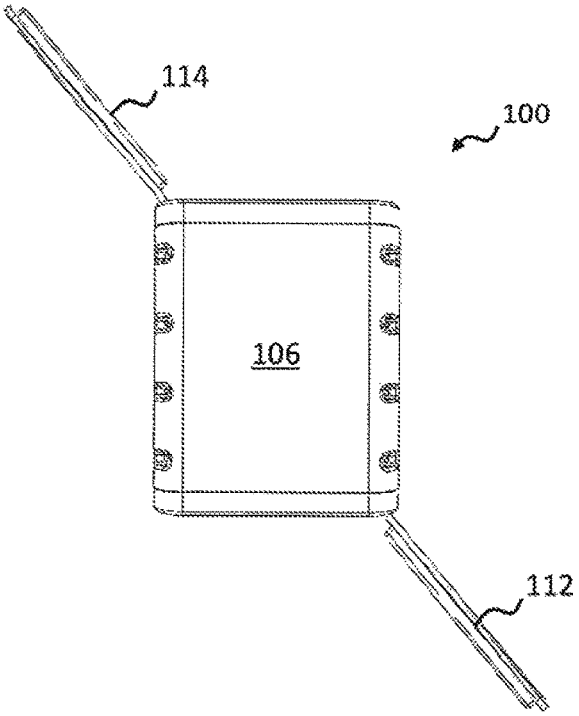
FIG. 2 illustrates an example of a transport pod.

In this example, but not necessarily all examples, the exterior panels are assembled into an approximately cuboidal shape. The exterior panels include a left side wall 102, a right side wall 104, a top wall 106, a bottom wall 108, and front and rear sides at least one of which comprises a closure 112, 114 (FIG. 2). The left and right side walls 102, 104 comprise a left side panel and a right side panel, upstanding generally vertically. The top and bottom walls 106, 108 comprise a top panel and a bottom panel, each interconnecting the left and right side walls 102, 104.

In some examples, new transport pods 100 are delivered disassembled and flat-packed. User fixings such as screws and seals enable end user assembly of the exterior panels 102, 104, 106, 108. In some examples, the transport pods 100 are collapsible when they are empty, to minimise wasted space during transport.

The transport pod 100 of FIG. 1A comprises a product storage space 101 configured to receive temperature-sensitive products. The product storage space 101 is a sealable interior void, thermally insulated to enable product temperatures to be kept within a user-required temperature range for at least several hours.

In some implementations or configurations, the product storage space 101 is configured to store a plurality of hand-portable delivery containers 124, such as the illustrated crates. In some examples, the crates can comprise bale arm crates, also referred to as bale arm trays or bale arm boxes. The product storage space 101 may store three or more hand-portable delivery containers 124. The illustrated product storage space 101 is configured to receive five hand-portable delivery containers 124.

In some implementations or configurations, the product storage space 101 comprises a plurality of shelf levels 120. The transport pod 100 in FIG. 1A comprises a column of shelf levels 120. Shelf levels 120 of the product storage space 101 can be divided by optional shelf plates 122 (FIGS. 3, 4, 6) or equivalent shelf level dividers. A shelf plate 122 may be supported by a combination of a left side wall 102 and a right side wall 104. The bottom wall 108 may provide a base shelf level 120. Each shelf level can comprise a shelf runner such as a wall groove engageable by sliders protruding from each shelf plate 122.

In some examples, the hand-portable delivery containers 124 can be hung within the shelf levels 120 of the product storage space 101, rather than resting on shelf plates 122. This provides an air gap beneath/around each hand-portable delivery container 124, to improve airflow. In some examples, the shelf plates 122 are omitted.

Figure 1B:
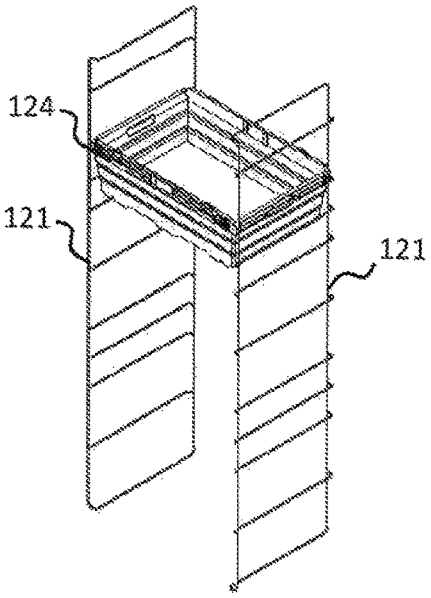
FIG. 1B illustrates an example of a hanging frame.

FIG. 1B illustrates an example hanging system. The hanging system comprises hanging frames 121 configured to hang one or more hand-portable delivery containers 124. Each hanging frame 121 may be secured to a pair of walls 106, 108 and/or 102, 104. Each hanging frame 121 may comprise a wireframe because a wireframe is a lightweight solution. The hanging frames 121 may provide a range of selectable vertical hanging spacings. The product storage space 101 may be compatible with more than one container width. Narrower containers may be hung or the hanging system may be detachable to enable wider containers to be stacked. The hanging frames 121 may extend from the top to the bottom of the transport pod 100 and clip in place allowing a range of crate/tray sizes to be hung in different configurations.

In some implementations or configurations, the product storage space 101 is configured to store a bulk fluid or containers of fluids. In some examples, the transport pod 100 is configured as a vending pod. The transport pod 100 may be configured as a refill station. The transport pod 100 may comprise one or more dispensers (not shown) such as taps for dispensing liquid from one or more reservoirs inside. Alternatively, granular or fragmented solids could be dispensed. Alternatively, the transport pod 100 may vend individual items.

In some implementations or configurations, the transport pod 100 is configured for bulk liquid transport. The transport pod 100 may comprise a sealed lining.

Figure 3:
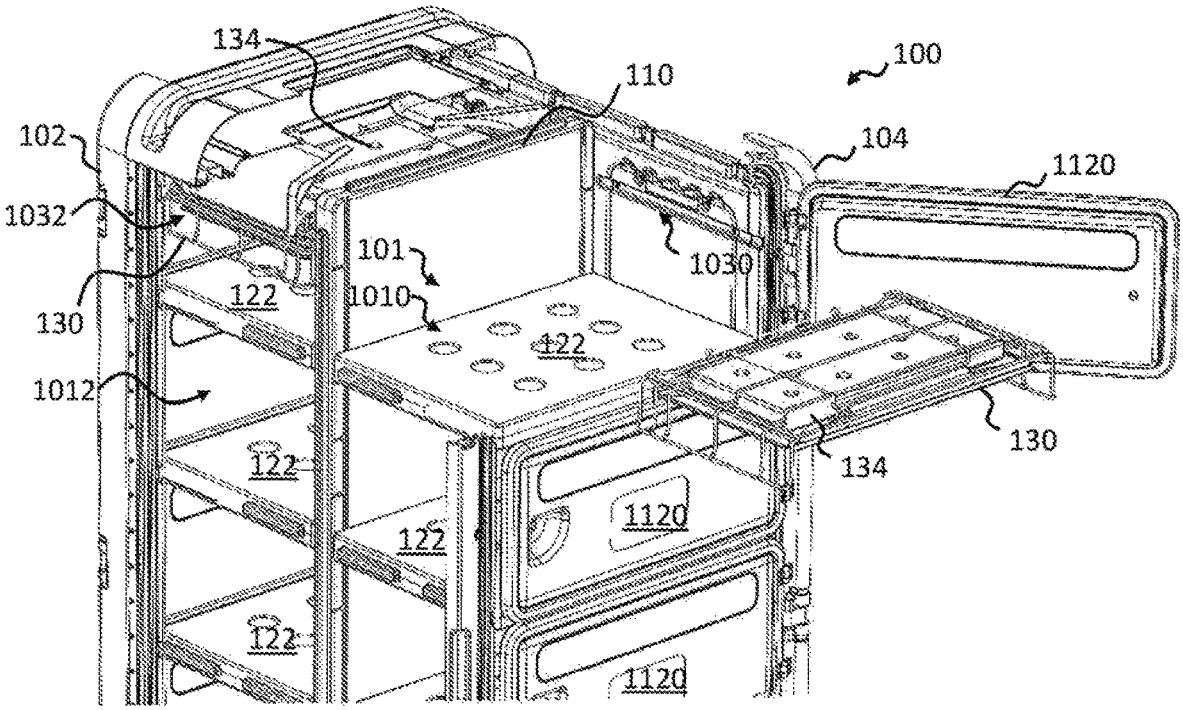
FIG. 3 illustrates an example of a transport pod.

As shown in FIG. 3, the transport pod 100 can optionally be double-sided, comprising a first product storage space 1010 at a first side of the transport pod 100 and a second product storage space 1012 at a second side of the transport pod 100, each configured to contain temperature-sensitive products or ambient temperature products. The first side may be the front and the second side may be the rear.

In some examples, each of the first and second product storage spaces 1010, 1012 is a sealable interior space, thermally insulated to enable product temperatures to be kept within a user-required temperature range for at least several hours.

The second product storage space 1012 and the first product storage space 1010 can be substantially thermally insulated from each other. For example, the transport pod 100 can comprise an internal divider 110 configured to separate the first product storage space 1010 and the second product storage space 1012 from one another. The internal divider 110 may be thermally-insulated. The internal divider 110 may comprise a VIP. In some examples, the internal divider 110 is upstanding in a generally vertical direction and may be positioned so that the first and second product storage spaces 1010, 1012 have approximately equal internal volumes. The internal divider 110 may be supported by the left side wall 102 and by the right side wall 104. The internal divider 110 may comprise shelf level features such as grooves for engaging with ends of shelf plates 122 or hand-portable delivery containers 124. Alternatively, the hanging system of FIG. 1B may be used.

In some examples, the first product storage space 1010 comprises a first plurality of shelf levels 120, and the second product storage space 1012 comprises a second plurality of shelf levels 120. The second shelf levels 120 can be the same as the first shelf levels 120, or implemented differently. In some examples, the second shelf levels 120 are vertically aligned with the first shelf levels 120. In further examples, the second product storage space 1012 is unshelved.

In some examples, the double-sided transport pod 100 can comprise more than six shelf levels 120 in total, such as more than three shelf levels 120 per side. The illustrated example comprises ten shelf levels 120 (five per side) for up to ten or more hand-portable delivery containers 124. The vertical spacing between each shelf level can be more than 20 centimetres.

The first product storage space 1010 is accessible by a first closure 112 shown in FIG. 2 but hidden from view in FIG. 1A. In some examples, the first closure 112 comprises a hinged door. The hinged door may be side-hinged as shown in FIG. 1A by the hinge 116 on one of the side walls 102 (or 104). The other side wall 104, 102 can comprise a latch 118. In some examples, the first closure 112 is lockable.

In a first implementation, the first closure 112 is opaque. In a second implementation, the transport pod 100 is configured as merchandise display unit and the first closure 112 is transparent.

In a first example, the first closure 112 can be sized so that all of the shelf levels 120 of the first product storage space 1010 are accessible via the first closure 112. In a second example, as shown in FIGS. 3, 7, 8, 11, 12 and 13, the transport pod 100 is configured as a locker pod, so that a separate closure 1120 is provided for each individual shelf level 120 or each individual group of one or more shelf levels 120.

In some examples, the transport pod 100 is configured for the different types of closure 112, 1120 described above. In such examples, the transport pod 100 can be reconfigured between a locker pod configuration and a large-door configuration using interchangeable parts.

If the transport pod 100 is double-sided, the second product storage space 1012 can be accessible by a second closure 114 as shown in FIGS. 1-2. The second closure 114 can be the same type of closure as the first closure, but can be on the opposite side of the transport pod 100. Optionally, and as shown in FIG. 2, the second closure 114 is hinged at a different side wall 104 than the first closure 112.

In another implementation, the double-sided transport pod 100 has no internal divider 110 so comprises a double-depth product storage space 101 accessible from either one of the first and second closures 112, 114 on the opposite sides of the transport pod 100. If one closure 112 or 114 is obstructed, the operator can still reach through to the other side. In some implementations, the internal divider 110 is operator-removable. This enables a user/operator to configure the transport pod 100 for different temperature ranges or for an enlarged capacity at one temperature range.

FIGS. 3-6 illustrate example implementations of the low energy or passive temperature control system for at least the first product storage space 1010 of the transport pod 100. For a double-sided transport pod 100, the same system or a different system or no system at all can be used for the second product storage space 1012.

In at least some examples, the first product storage space 1010 can be kept for several hours within a predetermined range of a target temperature ranging from ambient to −18 Celsius. The duration may be longer than 6 hours or longer than 10 hours. Alternatively, the first product storage space 1010 can be heated.

The transport pod 100 is configured to regulate a temperature of the first product storage space 1010 passively or with fan assistance. A vapor cycle refrigeration system is omitted. Such systems comprise compressors and heat exchanger fans having high energy requirements, necessitating an onboard power supply. Such systems would add weight and reduce internal volume.

As shown in FIG. 3, the transport pod 100 comprises at least one thermal energy storage device 134 for absorbing or emitting thermal energy to control a temperature of the first product storage space 1010. There are three main types of thermal energy storage system: sensible or single-phase, latent heat, and thermo-chemical storage. In the illustrated examples, but not necessarily all examples, the thermal energy storage device 134 comprises a latent heat storage device. The latent heat storage device comprises a phase change material. In an implementation, the transport pod 100 comprises a eutectic plate configured to control a temperature of the or each product storage space 101.

The temperature of the first product storage space 1010 can be configured by selecting a suitable quantity and type (formulation) of phase change material having a suitable phase change temperature. In a cooling implementation, the thermal energy storage device 134 is a thermal energy absorption device. In a heating implementation, the thermal energy storage device 134 is a thermal energy emission device. The following description refers to a cooling implementation, but covers both cooling and heating except where explicitly stated otherwise.

The thermal energy storage device 134 is provided within the sealed thermally-insulated space of the transport pod 100. Therefore, the transport pod 100 is self-contained with regard to temperature-control, and can be loaded into ambient vehicle cargo spaces. When the thermal energy storage device 134 is no longer effective, the thermal energy storage device 134 can be removed and recharged, or can be recharged in-situ by a plug-in external temperature control system (e.g., FIGS. 9-11, 326).

The thermal energy storage device 134 is vertically separated from the first product storage space 1010. For example, the first thermal energy storage device 134 may be either directly above or directly below the first product storage space 1010. If the thermal energy storage device 134 is a thermal energy absorption device, the thermal energy storage device 134 may be located above the first product storage space 1010 because cool air sinks. If the thermal energy storage device 134 is a thermal energy emission device for heating, the thermal energy storage device 134 may be located below the first product storage space 1010 because warm air rises.

In some examples, a thermal energy storage device 134 can be provided in or on a side wall 102, 104 of the transport pod 100. In some examples, a shelf plate 122 can be configured as a thermal energy storage device 134. In some examples, a thermal energy storage device 134 can be provided in or on the top or bottom wall 106, 108 of the transport pod 100. In some examples, a thermal energy storage device 134 can be provided in or on the internal divider 110 of the transport pod 100.

FIG. 3 illustrates an example of how one or more thermal energy storage devices 134 can be supported within the transport pod 100. In this example, the thermal energy storage devices 134 are for cooling, and are located above the product storage space 101 or spaces 1010, 1012.

In this example, but not necessarily all examples, one or more thermal energy storage devices 134 are supported by a removable thermal energy device support structure 130. The thermal energy device support structure 130 is a user-removable carrier, also referable to as a cassette. Thermal energy storage devices 134 can be loaded onto the thermal energy device support structure 130, then the thermal energy device support structure 130 can be loaded, for example by hand, or robotically into a thermal energy device space 103 of the transport pod 100.

A thermal energy device space 103 of the transport pod 100 is a location configured to receive and support one or more thermal energy storage devices 134. For example, the thermal energy device space 103 can be the location into which a thermal energy device support structure 130 can be inserted. For example, the transport pod 100 can comprise a receiving structure, such as a wall groove into which a slider of the thermal energy device support structure 130 can be inserted and slid into a supported position in the manner of a shelf. Alternatively, the hanging system of FIG. 1B may support the thermal energy device support structure 130.

The illustrated thermal energy device support structure 130 comprises a cage or similar frame to minimise blockage of airflow. In other examples, the thermal energy device support structure 130 comprises one or more plates with apertures therethrough, or any other appropriate air-permeable support.

A thermal energy device space 103 is vertically separated from its associated product storage space 101. For example, in a cooling implementation, the thermal energy device space 103 may be above the associated product storage space 101, such as directly vertically above the associated product storage space 101.

The thermal energy device space 103 and the thermal energy device support structure 130 are fluidly coupled to the associated product storage space 101 to enable a convective air flow between the thermal energy device space 103 and the associated product storage space 101 when in use. The convective airflow occurs spontaneously due to the air density changes imparted by the absorption (or emission) of thermal energy by the thermal energy storage device 134. Cool air falls from the illustrated thermal energy device space 103 to the associated product storage space 101.

In the illustrated example of a double-sided transport pod 100, multiple thermal energy device spaces 103 are provided including a first thermal energy device space 1030 and a second thermal energy device space 1032. The first thermal energy device space 1030 is fluidly coupled to the first product storage space 1010. The second thermal energy device space 1032 is fluidly coupled to the second product storage space 1012. The first thermal energy device space 1030 and the second thermal energy device space 1032 may be alongside each other and thermally insulated from each other, for example by the aforementioned internal divider 110 or by a separate divider. The use of separate first and second thermal energy device spaces 1030, 1032 enables one of the first and second product storage spaces 1010, 1012 to be kept at a first temperature (e.g., chilled), and the other of the first and second product storage spaces 1010, 1012 to be kept at a second temperature (e.g., frozen).

In an alternative implementation, a single thermal energy device space 103 is fluidly coupled to both the first product storage space 1010 and the second product storage space 1012, without the need for a second thermal energy device space 1032.

In the below description, features will be described in relation to the first product storage space 1010 and the first thermal energy device space 1030. To avoid repetition, a second one of each feature can be assumed to be provided for the second product storage space 1012 or second thermal energy device space 1032 except where explicitly stated otherwise.

Figure 4:
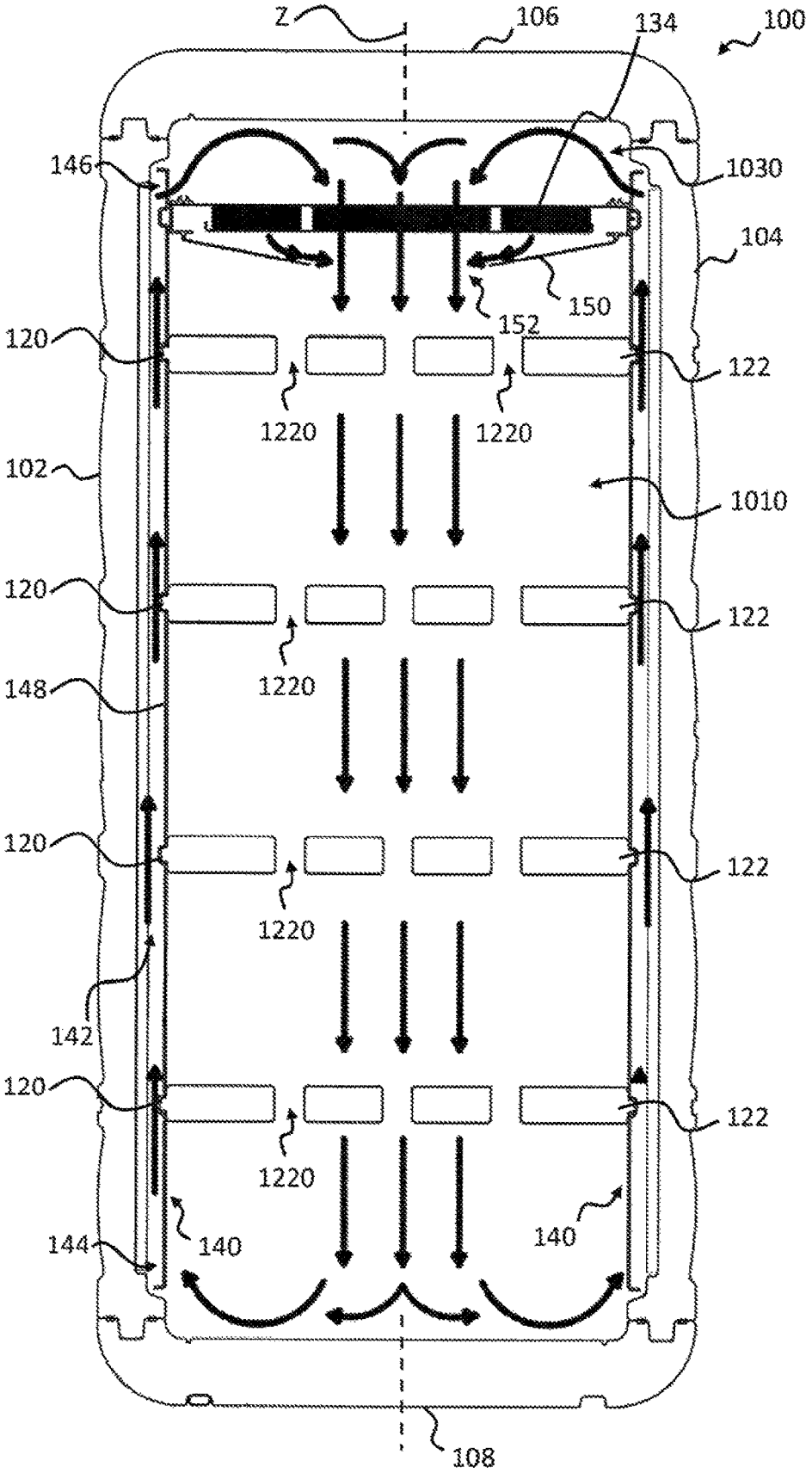
FIG. 4 illustrates an example of a transport pod comprising a convection cell flow guide and a throttle for controlling convective flow.

Referring now to the schematic drawings in FIGS. 4-6 and 9-10, various features for improving the convective airflow are shown and described below. Arrows in FIGS. 4, 6 and 10 illustrate the direction of airflow for a cooling implementation.

Simulations and experiments of a transport pod 100 revealed that the airflow from the thermal energy storage devices 134 can be turbulent, resulting in warm air close to the central vertical axis Z of the first product storage space 1010, with cooler air circulating around it. Therefore, a flow concentrator 150 has been devised. The flow concentrator 150 is configured to concentrate the convective airflow from the first thermal energy device space 1030 towards the central vertical axis Z of the first product storage space 1010. The flow concentrator 150 reduces turbulence and accelerates the airflow. This forms a jet which encourages circulation and disrupts any stratification of temperatures.

The illustrated flow concentrator 150 is located between the first thermal energy device space 1030 and the first product storage space 1010. As shown in FIG. 4, the flow concentrator 150 can comprise one or more sloped surfaces sloping at least partially towards the central vertical axis Z, and towards a central opening 152 between the sloped surfaces. The sloped surfaces can be arranged as a hopper or other funnel-like structure. Alternatively, the flow concentrator 150 can be horizontal.

Although one central opening 152 is shown, in other examples the flow concentrator 150 comprises a plurality of central openings. Regardless of how the openings are implemented, it can be said that the flow concentrator 150 has a maximum opening area at a central region of the flow concentrator 150. Further, an example flow concentrator 150 shown in FIG. 10 does not extend all the way to one or more peripheral walls (inner walls 148 or side walls 102, 104), so some airflow is able to pass around its periphery to the product storage space 101.

The central opening 152 functions as a throttle configured to control a flow rate of the convective air flow entering the first product storage space 1010. The throttle 152 accelerates and reduces the flow rate of the flow rate of the cold air from the first thermal energy device space 1030.

Figure 5:
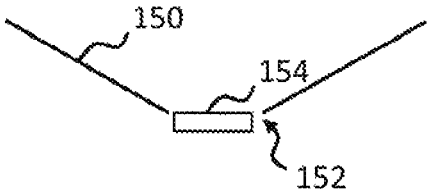
FIG. 5 illustrates examples of a variable throttle for controlling convective flow.

In FIG. 5, the throttle 152 is a variable throttle. That is, the central opening 152 of the flow concentrator 150 may be varied by a valve 154. Alternatively, the flow concentrator 150 and the variable throttle may be separate parts.

The ability to vary the opening of the throttle 152 provides more freedom when selecting a phase change temperature of a thermal energy storage device 134. For example, the phase change temperature of a thermal energy storage device 134 can be significantly colder than the required temperature of the first product storage space 1010, resulting in colder-than-required air being emitted. The throttle 152 can be set to a small opening that prevents supercooling of products proximal to the first thermal energy device space 1030. This enables the transport pod 100 to stay within the required temperature range for longer, as the thermal energy storage device 134 has a greater thermal energy storage capacity.

In a first example, the transport pod 100 comprises a passive automatic control system configured to vary an opening of the variable throttle 152 without user intervention. The passive automatic control system may be operable without electronic means. The passive automatic control system is configured to control the variable throttle 152 in dependence on a temperature. The temperature may be a temperature of the first product storage space 1010 or a temperature of the first thermal energy device space 1030. The passive automatic control system can comprise a passive thermostat. Passive thermostats can include mechanical thermostats that sense and control using purely mechanical means. In an example, the passive thermostat comprises a bimetal. In a further example, the passive thermostat comprises a phase change actuator that expands when it changes phase.

Note that the thermal flow is partly self-regulating as warming or cooling will accelerate the flow naturally, but in this example the flow self-regulates within the parameters of the variable throttle opening.

In a cooling implementation, the passive automatic control system can be configured to control the variable throttle 152 to reduce the flow rate in dependence on a low, falling temperature, to prevent localised supercooling.

In a heating implementation, flow rate can be reduced for a high, rising temperature. As mentioned previously, in a heating implementation a thermal energy emission device 134 may be located below the first product storage space 1010 because warm air rises. Features that are shown proximal to the top wall 106 would instead be proximal to the bottom wall 108.

In a second example, the transport pod 100 comprises a user manipulation device (not shown) configured to vary an opening of the variable throttle 152. An example is a mechanical input such as a lever or other tactile control, to open or close the variable throttle 152. The user manipulation device can be provided at the exterior of the transport pod 100 so that no closure has to be opened in order to access the user manipulation device.

In further examples, the automatic control system could be active. However, onboard electrical power would be required which adds complexity, weight and cost to each mass-produced transport pod 100. Such systems could however be useful if electrical power is available in the vehicle cargo hold.

As schematically illustrated in FIG. 5, the opening of the variable throttle 152 can be controlled by any appropriate valve 154 such as shutters, or a butterfly valve or any other appropriate plate arrangement.

As discussed above, the variable throttle 152, 154 enables cold phase change temperatures to be used without supercooling. Further, it has been found that stacking thermal energy storage devices 134 in a particular way enables cold phase change temperatures to be incorporated without a supercooling effect. This is achieved by stacking a thermal energy storage device 134 with a much colder phase change temperature above a thermal energy storage device 134 with a phase change temperature closer to the required temperature range of the temperature-sensitive products.

For example, if one wants to keep their products at +3 Celsius (C), the lower thermal energy storage device 134 could have a phase change temperature within 10 C of the required temperature, such as −3 C. The upper thermal energy storage device 134 could have a phase change temperature at least 10 C colder than that of the lower thermal energy storage device 134, such as −18 C. The airflow actually passing through to the first product storage space 1010 would be close to an average of the temperatures of the two thermal energy storage devices 134, and would likely not cause localised supercooling. This effect is further controllable if the variable throttle 152, 154 and the passive convection and a below-described 'chimney' effect ensuring constant circulation 152 is provided.

In FIGS. 4 and 6, the first product storage space 1010 comprises shelf plates 122 although this is not a requirement for all examples. In order to aid convection within the first product storage space 1010, each shelf plate 122 comprises one or more shelf apertures 1220 each comprising a through-hole through a thickness of the shelf plate 122, providing an air channel between neighbouring shelf levels 120. As shown in FIG. 6, a shelf plate 122 can comprise a two-dimensional array of shelf apertures 1220 to improve flow distribution. Some or all of the shelf apertures 1220 may be away from edges of the shelf plate 122. In some examples, the shelf plates may comprise PCM. In another implementation, the shelf levels are divided by frames rather than by plates.

As shown in FIGS. 4 and 6, the transport pod 100 further comprises one or more convection cell flow guides 140 configured to direct the convective air flow to recirculate in a convection cell spanning between the first thermal energy device space 1030 and the first product storage space 1010. Each convection cell flow guide 140 can function as a chimney to provide a low-resistance flow path for air at the bottom of the transport pod 100 to buoyantly rise back up to the thermal energy storage devices 134. The convection cell flow guide 140 helps to prevent cool air from pooling at the bottom of the transport pod 100.

The convection cell flow guide 140 spans between the first thermal energy device space 1030 and the first product storage space 1010. The convection cell flow guide 140 is a peripheral flow return path around the first product storage space 1010, located outside the first product storage space 1010. Therefore, the return path cannot be blocked by products, shelf plates 122, or hand-portable delivery containers 124.

As shown in FIGS. 4 and 6, a convection cell flow guide 140 can be provided at each of the left side and right side of the transport pod 100, to enable a pair of counter-rotating convection cells as illustrated. Optionally, a convection cell flow guide 140 can be provided at a front side and/or a rear side or at the internal divider 110, integrated with a closure 112, 114 or with the internal divider 110.

Referring to FIG. 4, the convection cell flow guide 140 can comprise a channel 142 for airflow to return to the first thermal energy device space 1030. The channel 142 is located at a lateral periphery of the interior of the transport pod 100, away from the central vertical axis Z. The channel 142 can comprise a substantially vertical duct, substantially parallel to the upstanding walls 102, 104, to ensure smooth flow. The channel 142 is within the interior of the transport pod 100, and is therefore thermally insulated by the walls 102, 104, 106, 108.

In the FIGs, the channel 142 of the convection cell flow guide 140 is located between the lateral perimeter of first product storage space 1010 and an outer upstanding wall 102, 104 or the internal divider 110 of the transport pod 100.

The channel 142 of the convection cell flow guide 140 is fluidly coupled to the first product storage space 1010 by a first aperture 144 towards the bottom end of the channel 142. The channel 142 is fluidly coupled to the first thermal energy device space 1030 by a second aperture 146 towards the top end of the channel 142. The channel 142 is a substantially fully enclosed conduit or a mostly enclosed conduit between the first aperture 144 and the second aperture 146. The first aperture 144 is an inlet and the second aperture 146 is an outlet. Alternatively, the flow direction can be in the reverse direction in some implementations.

The first aperture 144 may be below the lowest shelf plate 122 of the first product storage space 1010. The first aperture 144 may be at the base shelf level 120. The first aperture 144 may be proximal to the bottom wall 108 of the transport pod 100. The first aperture 144 may comprise a single aperture such as an elongate aperture (slit/window/letterbox). Alternatively, the first aperture 144 may comprise a plurality of smaller apertures.

The second aperture 146 may be proximal to the top wall 106 of the transport pod 100. The second aperture 146 may be above the height of the thermal energy storage device 134. The second aperture 146 may comprise a single aperture such as an elongate aperture (slit/window). Alternatively, the second aperture 146 may comprise a plurality of smaller apertures.

The channel 142 of the convection cell flow guide 140 may be thin. A thin channel 142 minimises packaging space and promotes low-velocity laminar flow within the channel, to reduce wall heat transfer. The average thickness of the channel 142 may be from the range 5 cm to 45 cm.

Regarding the construction of the convection cell flow guide 140, the transport pod 100 can comprise a double wall as illustrated in FIGS. 4 and 6, wherein the channel 142 of the convection cell flow guide 140 is in the interior space of the double wall, between an inner wall 148 and an outer wall of the double wall. The inner wall 148 of the double wall separates the channel 142 from the first product storage space 1010, and the outer wall of the double wall is an outer upstanding wall 102/104/110 of the transport pod 100. In some examples, the outer wall is a surface of a VIP 1042 shown in FIG. 6. The inner wall 148 may be removably secured (e.g., clipped) in place and may be removable if a convection cell flow guide 140 is not required.

In some examples, the inner wall 148 may comprise a heat reflective layer and/or a thin layer of insulation to aid a reduction of heat transfer between the product storage space 101 and the channel 142.

The proximity of the channel 142 to the exterior of the transport pod 100 has an advantageous effect. In a cooling implementation, ingress of heat through the outer wall 102/104/1042 will increase the temperature of the air in the channel 142 and accelerate the convection cells. Similarly, in a heating implementation, heat escaping from the channel through the outer wall 102/104/1042 will accelerate the convection cells.

As shown in FIGS. 4 and 6, the inner wall 148 of the double wall can be configured to support the weight of the products and/or hand-portable delivery containers 124. For example, the inner wall 148 can comprise, at its product-storage-space-facing side, one or more shelf level dividers such as shelf runners (e.g., wall grooves for shelf plates 122 or hand-portable delivery containers 124). Alternatively, a hanging system 121 can be provided as shown in FIG. 1B.

FIG. 1A illustrates spacers 149 configured to maintain a required separation between the inner wall 148 and the outer wall 1042 of FIGS. 4 and 6. The spacers 149 are not visible in FIGS. 4-6. The example spacers 149 shown in FIG. 1A comprise moulded indents in the surface of the inner wall 148, but could take another form.

As described earlier, the transport pod 100 can be available in different variants. FIGS. 7-13 illustrate a dockable variant of the transport pod 100 in more detail, by illustrating a system 200. The portable transport locker pod 100 can come in temperature-controlled variants as illustrated and described, or non-temperature-controlled variants.

In this example, but not necessarily all examples, the transport pod 100 is a locker pod variant with multiple closures 1120 and shelf plates 122 for the product storage space 101, the closures 1120 and shelf plates 122 defining lockers L.

The locker system 200 can be configured as a 'click and collect' style system, comprising a docking station 300 configured as a collection point for delivery recipients or as a hub for a last mile delivery service. The locker system 200 comprises transport locker pods 100 that are configured to be docked to and undocked from the docking station 300.

An advantage of the locker system 200 is that the transport locker pod 100 can be packed at a central hub, such as a warehouse, and then transported to the docking station 300. The central hub may deliver transport locker pods 100 to a plurality of docking stations 300 at different locations. This efficiently prevents duplication of drop-off points for different couriers in a polyopolistic courier market, reducing overall mileage, and emissions. This also reduces labor requirements and increases security, temperature integrity and food hygiene. for the operators of the delivery networks and collection points.

Further, as will be described, many of the electronic components and complex systems can be built into the docking station 300 rather than the transport locker pods 100, enabling the transport locker pods 100 to be voluminous, lightweight and to have lower maintenance requirements. Temperature-controlled transport locker pods 100 can be passive or near-passive, utilizing the features from earlier FIGS. 4-6.

Figure 8:
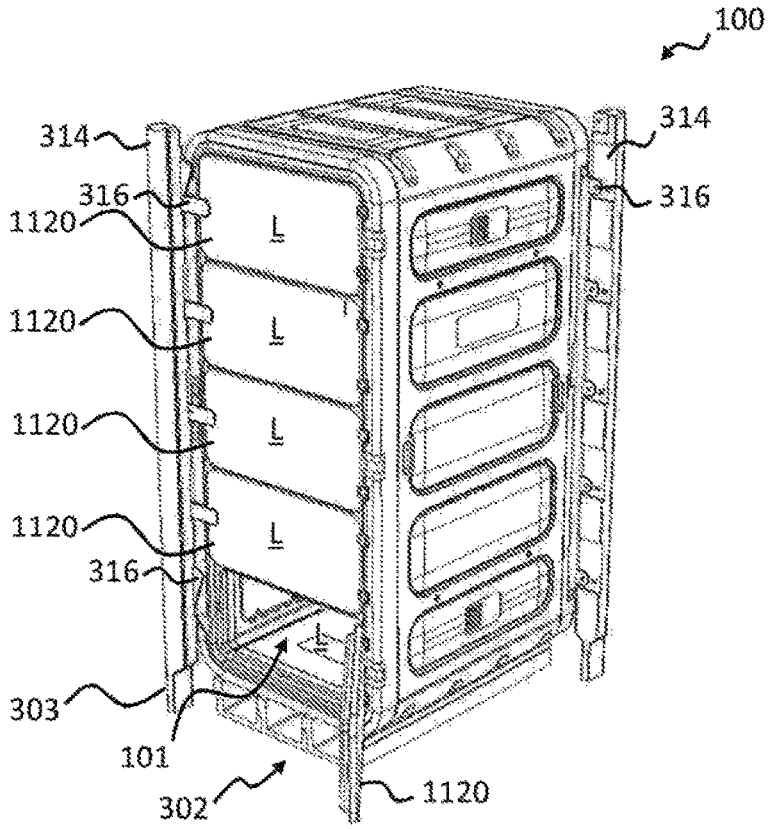
FIG. 8 illustrates an example of a transport locker pod coupled to a lock actuator system of a docking station.

Each locker L of the transport locker pod 100 can be a self-contained unit for storing products to be delivered. For security, each locker L can be accessible via an individual closure 1120 as shown in FIG. 8, and can be separated from each other locker L by a shelf plate 122. Any openings in the shelf plates 122, such as the earlier-described shelf apertures 1220/channels for airflow, may be sized to be smaller than a human hand to prevent users from reaching to a neighbouring locker L. For example, each opening in the shelf can have a maximum dimension (e.g., diameter) smaller than 8 cm or smaller than 5 cm.

Figure 7:
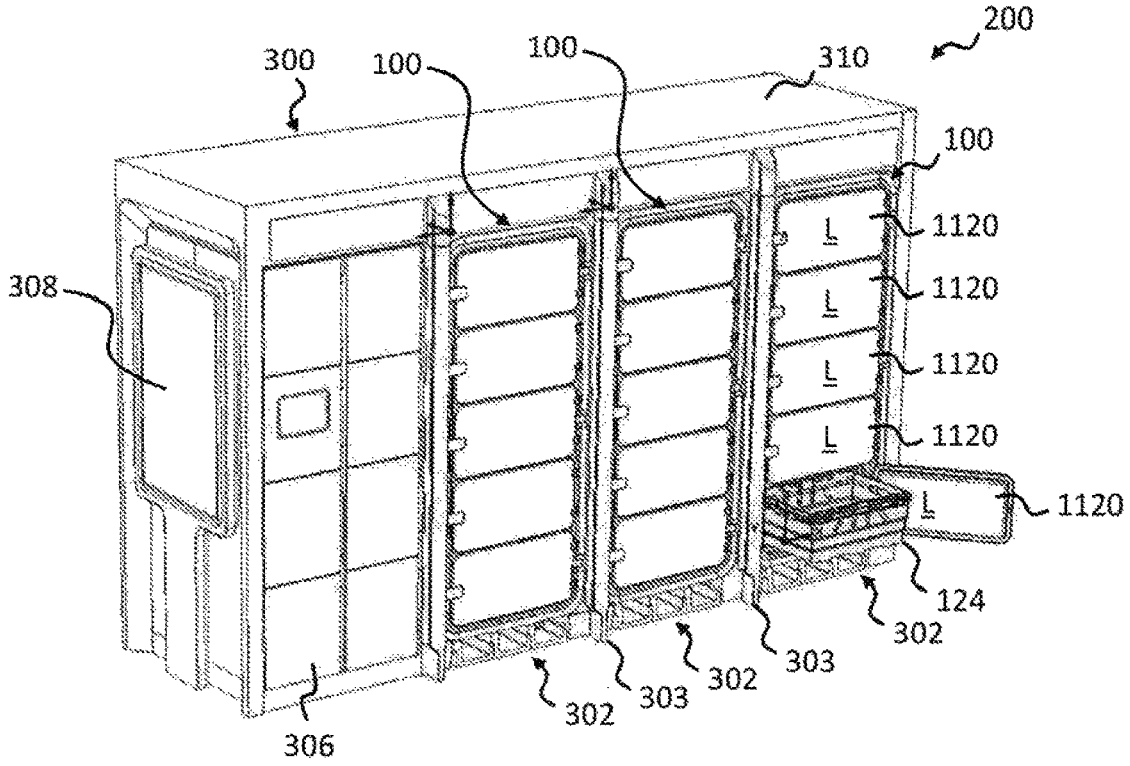
FIG. 7 illustrates an example of a locker system.

FIG. 7 illustrates the docking station 300 with transport locker pods 100 docked therein. The docking station 300 comprises a plurality of docks 302 each configured to receive (to dock) and release (to undock) one of the transport locker pods 100. Each dock 302 and each locker pod 100 may be standardised. A transport locker pod 100 can be compatible with a plurality of different docks 302 and potentially with a plurality of different docking stations 300.

A dock 302 comprises a space into which a transport locker pod 100 can be inserted, enabling one or more docking functions to be carried out such as temperature recharge (top-up), electrical power, locker unlocking or the like.

The docking station 300 may be modular, enabling further docks 302 to be added.

A dock 302 may be open at both its front and rear sides. In some examples, a transport pod 100 can be inserted from either the front or rear. This arrangement is also useful if the transport pod 100 is double-sided.

The docking station 300 may comprise a bridge 310, providing a conduit for one or more services to the transport locker pods 100. The bridge 310 may pass over one or more docks 302. The transport locker pods 100 and a temperature recharge (top-up) system may be located under the bridge 310 when docked. During undocking, a transport locker pod 100 can be wheeled out or moved by material handling equipment.

In some examples, the docking station 300 further comprises a set of integrated lockers 306 which are not undockable. These integrated 'standard parcel' lockers 306 provide the ability for some couriers to drop off consignments directly if this is more local/efficient than dropping them off at the central hub. The integrated lockers 306 may be non-temperature controlled, for ambient temperature parcels. The docking station 300 can enable combined collection of parcels and temperature controlled goods.

The docking station 300 of FIG. 7 can also comprise a delivery recipient interface 308 configured to enable a delivery recipient to provide an access request for opening a locker L to collect their products. A delivery recipient interface 308 can comprise a touchscreen, display, keypad or other similar console. Additionally, or alternatively, the delivery recipient interface 308 can comprise a wireless communication interface to enable an access request from a user equipment (e.g., mobile terminal).

Figure 11:
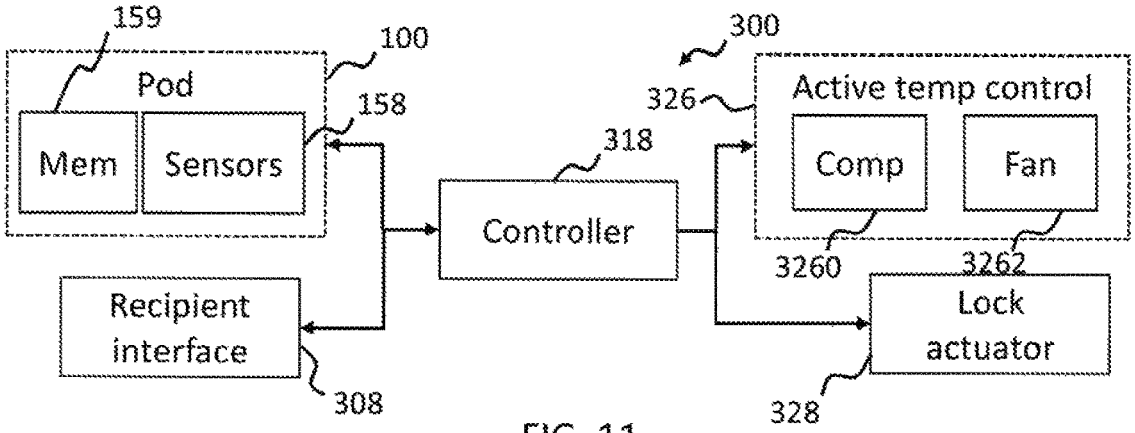
FIG. 11 illustrates an example of a control system.

The lockers L of the transport locker pod 100 can be unlocked in dependence on an electronic unlock signal triggered by a successful access request. In at least some examples, the transport locker pod 100 itself may forego any electronic lock actuation components. Instead, as shown in FIGS. 8, 11 and 12, a self-contained lock actuator system with all the components 328, 316 needed to lock and unlock each locker L, may be provided separately from the transport locker pod 100, as part of the docking station 300.

Figure 12:
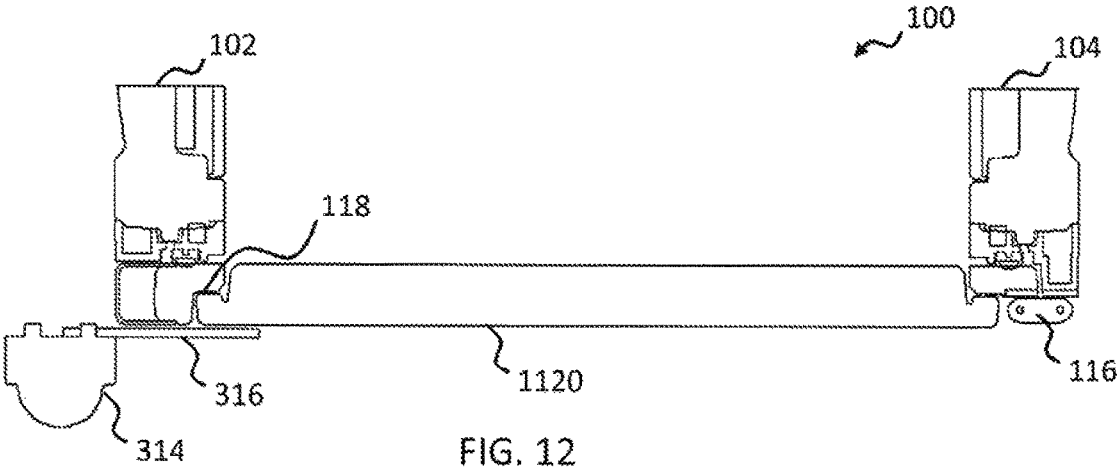
FIG. 12 illustrates an example of a transport pod comprising a latching system.

In an example implementation shown in FIGS. 8 and 12, actuatable interference portions 316 are mounted to a part of the docking station 300 and are each movable into and out of interference with each locker closure path. The interference is possible if the transport locker pod 100 is correctly positioned in the dock 302. In an implementation, the interference portions 316 comprise rotatable cam locks or slidable portions. The interference portions 316 may each be actuatable into a hinged swing path of a locker closure 1120 to prevent unauthorised opening of the locker closure 1120.

The interference portions 316 may be provided on an upstanding structure 314 of the docking station 300. For example, the docking station 300 can comprise one or more dock dividers 303 to demarcate neighbouring docks 302. Each dock divider 303 may comprise a pillar 314 or similar upstanding structure. The upstanding structure 314 may position the interference portions 316 proximal to a corner of a dock 302, so that the interference portions 316 are within reach of the path of the swingable edge of each locker closure 1120. Each interference portion 316 can be at a different vertical position on the upstanding structure 314, their vertical spacing being approximately equal to the vertical locker-to-locker spacing of the transport locker pod 100.

In FIGS. 7-8, a lowest one of the interference portions 316 of the docking station 300 is in an unlocked position, and the corresponding lowest locker closure 1120 of the transport locker pod 100 is open. The other interference portions 316 are in their locked positions and their corresponding locker closures 1120 are closed.

In the above example, locking and unlocking is achieved using mechanical interference portions 316. It would be appreciated that different means such as magnetic portions could be provided.

In the above example, the interference portions 316 are not part of the transport locker pod 100. However, in another embodiment, the transport locker pod 100 comprises the interference portions 316 but not the electronic means for actuating them. The interference portions 316 would only be actuatable when docked.

In the example of FIG. 8, but not necessarily in all examples, the transport locker pods 100 are double-sided. Therefore, another set of interference portions 316 is illustrated at the rear side of the dock 302 for the rear lockers L of the same transport locker pod 100.

If the transport locker pods 100 are double-sided, it would be useful for the delivery recipient interface 308 to be located at an end face of the docking station 300, as shown in FIG. 7. A user facing the delivery recipient interface 308 would be side-on to the transport pods 100 and can be directed to a locker at either the user's left side or right side.

In at least some examples, the docking station 300 further comprises the relevant electronic components of the lock actuator system such as a controller 318 (FIG. 11) for outputting the electronic unlock signal, and one or more lock actuators 328 each configured to convert electrical energy to a mechanical output, in dependence on an electronic unlock signal, to actuate an interference portion 316. The interference portions 316 may be individually addressable. For example, a separate lock actuator 328 is provided for each interference portion 316, each lock actuator 328 being individually addressable by the controller 318.

In at least some examples, a docking operation may require the lock actuator system associated with one or both sides of the dock 302 to be in an unlocked state. For example, the interference portions 316 for a dock 302 may be at their unlocked positions before docking, or may be moved to the unlocked positions for docking. This allows access for an operative to move the transport locker pod 100 into the dock 302 from at least one side of the dock 302. Once the transport locker pod 100 has been moved into the dock 302, the interference portions 316 may be moved to their locked positions. This not only locks the lockers L, but also block the transport locker pod 100 from being undocked. The reverse may be performed for undocking. A terminal such as the delivery recipient interface 308 may comprise an authentication/authorisation interface to enable an authorised operative to control the lock actuator system to initiate a docking or undocking procedure.

In order to prevent the locker closures 1120 from swinging open when the transport locker pod 100 is undocked and in transport, the transport locker pod 100 may comprise a latch 118 for each locker closure 1120, as shown in FIG. 12. Various latch types could be used, such as push-to-release or pull-to-release.

In order to further secure the transport locker pod 100 when undocked, the transport locker pod 100 may optionally be provided with a non-electronic locker locking system (not shown). The non-electronic locker locking system may comprise a key barrel lock or similar passive means. The non-electronic locker locking system may secure all of the locker closures 1120 at one or more sides of the transport locker pod 100 collectively, without separate non-electronic locks being provided for each individual locker closure 1120. This reduces the number of mechanisms and keys, and also speeds up the loading and unloading of the transport locker pod 100 at the central hub.

As mentioned earlier, a temperature-controlled variant of the transport locker pod 100 is provided. A docking station 300 configured to receive temperature-controlled transport locker pods 100 may comprise the aforementioned external temperature control system 326 to maintain product temperatures while the transport locker pod 100 is docked, and to recharge any phase change material present in the transport locker pods 100.

Figure 9:
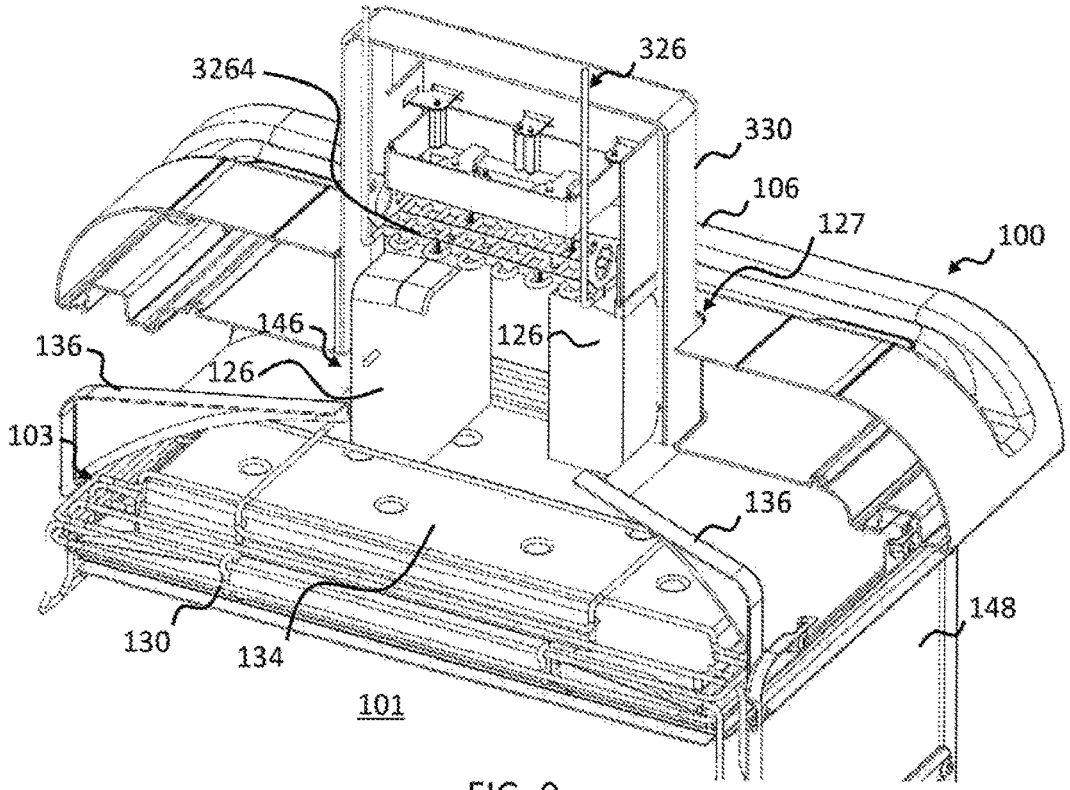
FIG. 9 illustrates an example of a transport pod and an external temperature control system.
Figure 10:
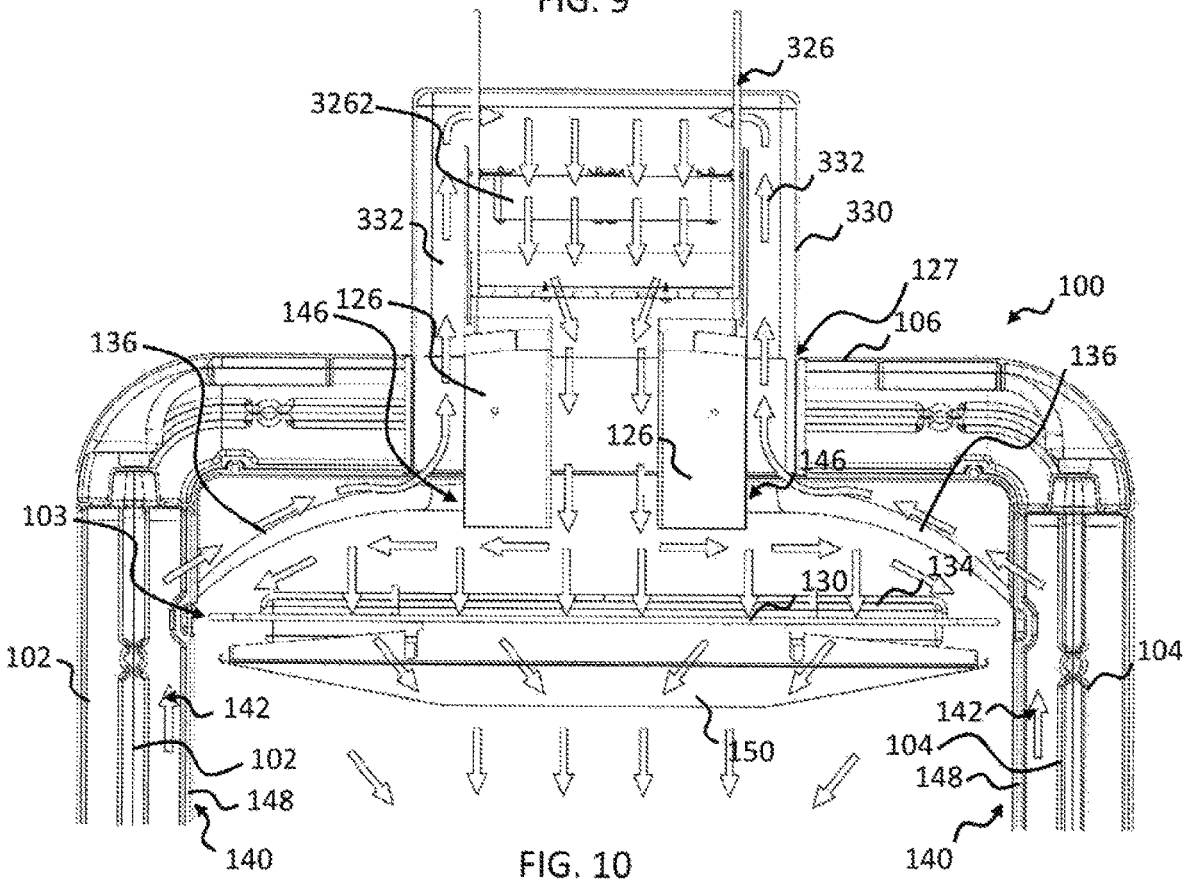
FIG. 10 illustrates an example of a transport pod and an external temperature control system.

FIGS. 9-11 illustrate a non-limiting example of how the transport pod 100 may be configured to fluidly couple to an external temperature control system 326 of the docking station 300.

As shown in FIGS. 9-10, the transport pod 100 comprises a fluid interface 127 configured to enable a fluid coupling to the external temperature control system 326, to enable thermal energy transfer via two-way exchange of fluid between the first (or second) thermal energy device space 1030 and the external temperature control system 326.

In at least some examples, the fluid is air, wherein the external temperature control system 326 captures air from the transport pod 100 and blows the air back at a required temperature into the transport pod 100. The recharge air may be blown into the thermal energy device space 103. In some examples, the external temperature control system 326 may receive air siphoned from one or more convection cell flow guides 140 and may blow cool air back into the thermal energy device space 103, to keep the convection cell(s) circulating.

In other examples, a different fluid is introduced such as refrigerant, wherein the transport pod 100 comprises an evaporator or condenser that is only operable when coupled to the external temperature control system 326.

The fluid interface 127 may be configured to engage with any appropriate fluid conduit such as a probe 330.

In some examples, the fluid interface 127 comprises a sealing strip (not shown) to provide a seal with the probe 330 and inhibit air leakage or ingress around the outside of the probe 330. An example sealing strip comprises silicone.

FIGS. 9-10 also illustrate an obstructor 126 of the fluid interface 127. The obstructor 126 has a closed position (not shown) configured to prevent fluid exchange between the transport pod 100 and an external environment when the transport pod 100 is not coupled to the external temperature control system 326, such as when the transport pod 100 is in a vehicle cargo hold.

In FIGS. 9-10, but not necessarily all examples, the obstructor 126 comprises a member configured to be displaced by the probe 330 into the illustrated open position. When the probe 330 is removed, the obstructor 126 may be moved back into its closed position by a spring or by the operator. The movement may comprise rotation and/or translation. Alternatively, the obstructor 126 may be a manually removable bung or other plug that is manually replaced when the probe 330 has been disengaged.

In FIGS. 9-10, but not necessarily all examples, when the obstructor 126 in its open position, the obstructor 126 at least partially blocks the second aperture 146 of the convection cell flow guide 140 and diverts the airflow to the external temperature control system 326. The obstructor 126 in the open position diverts the airflow through an opening in the upper wall 106 to a diversion channel 332 in the probe 330, to siphon air from a convection cell flow guide 140. The convection cell flow guides 140 may extend to the fluid interface 127, so that the second aperture 146 of each convection cell flow guide 140 is proximal to the fluid interface 126 and can be blocked by the obstructor 126. For example, the convection cell flow guide 140 can comprise channel extensions 136 extending inwardly from an upper portion of the side wall 102 or 104 towards the more centrally-located fluid interface 127. The fluid interface 127 may be coaxial with or proximal to the central vertical axis Z. Airflow may be constrained between the upper wall 106 and a channel extension 136. The end of the channel extension 136 comprises the second aperture 146, and is blockable by the obstructor 126.

In a different implementation, the probe 330 creates the diversion, rather than the obstructor 126. The probe may be a double-walled/double-tubed, the outer wall comprising the diversion channel 332 and the inner wall being fluidly coupled to the thermal energy device space 103. The outer wall and inner wall may have different lengths so that the longer wall blocks the second aperture 146 to create the diversion.

The diversion channel 332 leads to the external temperature control system 326, where the air is chilled and then cascades down into the thermal energy device space 103.

In a heating implementation, the flow direction is opposite to that shown. In a heating implementation, the probe 330 may still be located at/near the top of the transport pod 100, even if the thermal energy device space 103 is at the bottom of the transport pod 100. The probe 330 will remain at the top of the pod whether heating or cooling. The natural fluid flow would suggest that the cold air is driven down the center and up the sides (channels 142) as it warms and this flow would be accelerated when topping up (recharging). If the external temperature control system 326 is providing additional heat then the PCM 134 may be located at the bottom of the pod and the convection flow may travel up the centre and down the sides (channels 142) as it cools, in which case the external temperature control system 326 may blow the hot air down the sides.

FIGS. 9-10 illustrate the external temperature control system 326 comprising one or more fans 3262 and a heat exchanger 3264 such as an evaporator or condenser, and/or comprising a heater element for heating implementations. The fans 3262 and heat exchanger 3264 are located within the probe 330 to enable the air to take the shortest route, but could be located elsewhere in other examples such as in the transport pod 100.

If the transport pod 100 is double-sided, a second fluid interface 127 for a second probe 330 may be provided for the second thermal energy device space 1032 to enable recharging to different temperatures. The probes 330 could have a combined double-headed configuration but may still provide the option of keeping the different product storage spaces 1010, 1012 at different temperatures.

FIG. 11 schematically illustrates a control system comprising a controller 318 and the external temperature control system 326 integrated into the docking station 300. An example controller 318 comprises a processor, memory and computer program code. As mentioned, the external temperature control system 326 is an active temperature control system 326 comprising, for example, a refrigerant or heating loop with energy-consuming components such as a compressor 3260, and one or more fans 3262 such as an evaporator fan and/or a condenser fan. In some examples, the active temperature control system 326 comprises a reversing valve configured to operate in heating and cooling modes. In some examples, a separate active temperature control system 326 is provided for each dock 302, or one or more components may be shared. The bridge 310 can provide a useful carrier for fluid conduits of the active temperature control system 326.

In an example control method, the controller 318 is configured to control the active temperature control system 326 in a closed loop manner in dependence on a temperature-indicating signal, to maintain a setpoint temperature or temperature range.

The temperature-indicating signal can come from any appropriate sensor 158 in the transport pod 100.

In some examples, the transport locker pod 100 comprises further sensors 158 and/or a programmable memory device 159.

The further sensors 158 can comprise a door sensor, to indicate if a closure 112, 1120, 114 has been opened in transit. The door sensor may comprise a light sensor, or any other appropriate sensor. An impact sensor may indicate impacts in transit. The above-mentioned temperature sensor 158 may indicate excursions from a required temperature range during transit.

The programmable memory device 159 may store indications of which consignments are in which lockers L. The indications may be transferred to or accessed by the controller 318 of the docking station 300 when the transport pod 100 is docked.

In some examples, the transport pods 100 may comprise location sensors such as global positioning system sensors, for logistics.

The same controller 318 or a different controller may be configured to control unlocking. FIG. 11 illustrates the controller 318 being configured to receive an access request from the delivery recipient interface 308. The controller 318 can then initiate an access control operation to obtain an identification of a locker L to be unlocked. For example, the controller 318 may contact a remote server or request a local database lookup. Once the identification is obtained, the locker L then transmits the electronic unlock signal to the correct lock actuator 328 of the identified locker L.

The delivery recipient can then unlatch the locker closure 1120. In some examples, the locker closure 1120 is configured to self-unlatch or to self-open. In some examples, the interference portion 316 is visible to the delivery recipient in its locked position, so that when it moves to the unlock position, the delivery recipient can see which locker L has been unlocked. Additionally, or alternatively, the docking station 300 may comprise an electronic indicator for each locker L, such as vertically spaced illuminators on the upstanding structure 314, wherein the electronic indicator for the identified locker L is controlled to render an indication. Additionally, or alternatively, the delivery recipient interface 308 may be controlled to render an instruction of which locker L to open. Once the products have been collected, the delivery recipient may be prompted to close the locker closure 1120, for example by the delivery recipient interface 308.

The above example docking station 300 is for a locker pod implementation. In other implementations or configurations, the docking station 300 can be used for transport pods 100 other than locker pods. For example, the transport pods may be merchandise display pods or vending pods such as refill stations, as described earlier. Access control may or may not be required.

Figure 13:
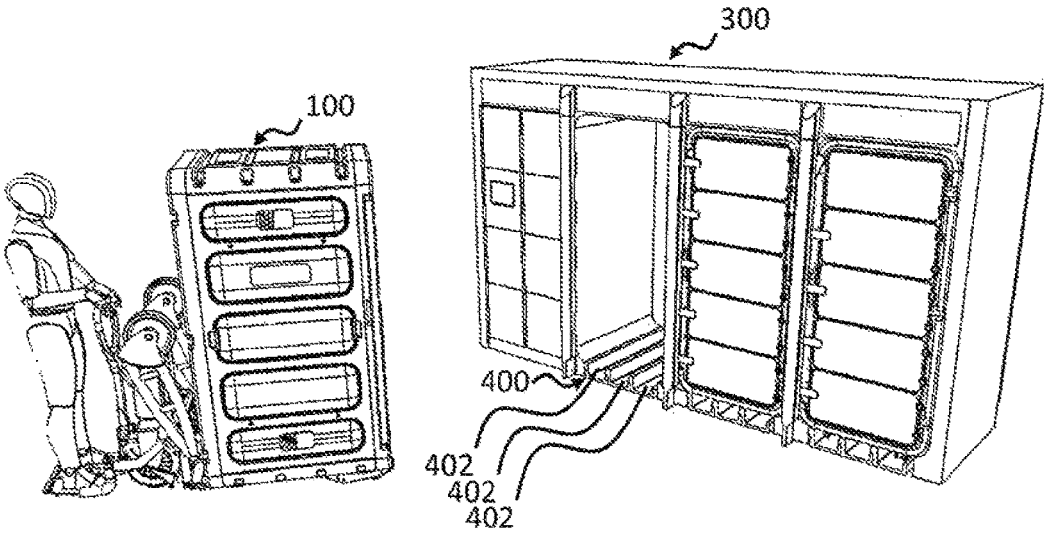
FIG. 13 illustrates an example of a receptor onto which a transport pod can be placed.

FIG. 13 illustrates a structure for enabling convenient docking and undocking of transport locker pods 100 with material handling equipment. The structure comprises a receptor 400 placed in one or more of the docks 302 separately from the transport locker pod 100. Each receptor 400 comprises a plurality of support members 402 for supporting one of the transport pods or transport locker pods 100. The support members 402 are spaced from each other, for example in a comb-like pattern or an array, and define an access formation between adjacent support members 402, each access formation having a top opening, so that lifting members of a material handling equipment are insertable into the access formations and thereafter raised through the top openings to lift the transport pod 100 on the support members 402 from the support members 402. Additionally, or alternatively, transport locker pods 100 can comprise wheels 125.

Although embodiments of the present invention have been described in the preceding paragraphs with reference to various examples, it should be appreciated that modifications to the examples given can be made without departing from the scope of the invention as claimed.

The variable throttle 152, 154 may have three or more opening sizes. The variable throttle 152, 154 may have a continuously variable opening size.

Air may rise (or fall) through the central opening 152. The central opening 152 may be substantially centered on the Z-axis The central opening 152 may directly fluidly couple the spaces 1010, 1030. The variable throttle 152, 154 may define at least in part a barrier dividing the spaces 1010, 1030. The barrier may be a horizontal wall.

The interference portions 316 may be in front of each locker closure 1120 when interfering with each locker closure path. The interference portions 316 may therefore be externally visible.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A thermally-insulated transport pod for storage and transport of temperature-sensitive products, the transport pod comprising:

a product storage space configured to contain temperature-sensitive products;

a thermal energy device space configured to hold at least one thermal energy storage device for absorbing or emitting thermal energy to control a temperature of the product storage space, wherein the thermal energy device space is fluidly coupled to the product storage space to enable a convective air flow between the thermal energy device space and the product storage space when in use;

a convection cell flow guide configured to direct the convective air flow to recirculate in a convection cell spanning between the thermal energy device space and the product storage space; and a flow concentrator configured to concentrate convective air flow from the thermal energy device space towards a central vertical axis of the product storage space to form a jet, wherein the flow concentrator is between the thermal energy device space and the product storage space and comprises a central opening.

2. The transport pod of claim 1, wherein the thermal energy storage device comprises a phase change material.

3. The transport pod of claim 1, wherein the convection cell flow guide comprises a channel at a periphery of the transport pod, wherein the channel is fluidly coupled to the product storage space by a first aperture at a distal elevation from the thermal energy device space, and is fluidly coupled to the thermal energy device space by a second aperture, wherein the channel is a fully enclosed conduit between the first aperture and the second aperture, and wherein the first aperture is proximal to a bottom wall of the transport pod.

4. The transport pod of claim 1, comprising a thermal energy device support structure configured to receive the thermal energy storage device.

5. The transport pod of claim 4, wherein the thermal energy device support structure is a user-removable carrier, or wherein the thermal energy device support structure comprises an air-permeable support, or a combination thereof, the air-permeable support comprising a frame or one or more plates with apertures therethrough.

6. The transport pod of claim 1, comprising a variable throttle configured to control a flow rate of the convective air flow entering the product storage space.

7. The transport pod of claim 1, comprising a hanging system configured to hang hand-portable delivery containers so that air gaps are provided between the hand-portable delivery containers, wherein the hanging system comprises hanging frames.

* * * * *